United States Patent [19]

Graham et al.

[11] Patent Number: 4,654,983

[45] **Date of Patent: * Apr. 7, 1987**

[54] SOLE CONSTRUCTION FOR FOOTWEAR

[75] Inventors: Kenneth W. Graham, Wakefield; Edward J. Norton, Oxford, both of Mass.; Shuhei Kurata, Fukuoka, Japan

[73] Assignee: New Balance Athletic Shoe, Inc., Boston, Mass.

[ * ] Notice: The portion of the term of this patent subsequent to Nov. 12, 2002 has been disclaimed.

[21] Appl. No.: 813,752

[22] Filed: Dec. 26, 1985

Related U.S. Application Data

[63] Continuation of Ser. No. 617,388, Jun. 5, 1984, Pat. No. 4,561,140, which is a continuation-in-part of Ser. No. 535,288, Sep. 23, 1983, Pat. No. 4,551,930.

[51] Int. Cl.[4] ..... A43B 13/14; A43B 13/18; A43B 13/04

[52] U.S. Cl. ..... 36/30 R; 36/32 R; 36/37; 36/114

[58] Field of Search ..... 36/30 R, 30 A, 32 R, 36/31, 37, 28, 114, 129, 44, 69, 104; 12/146 BR, 146 B, 142 RS; 264/244; 425/129 S

[56] References Cited

U.S. PATENT DOCUMENTS

| | | | |
|---|---|---|---|
| 2,055,574 | 9/1936 | Hartl . | |
| 2,410,019 | 10/1946 | Davis . | |
| 2,911,973 | 11/1959 | Chieffo . | |
| 2,962,738 | 12/1960 | Andrade et al. . | |
| 3,474,496 | 10/1969 | Klee . | |
| 3,742,622 | 7/1973 | Dassler . | |
| 4,123,493 | 10/1978 | Schilke et al. . | |
| 4,128,950 | 12/1978 | Bowerman et al. | 36/30 R |
| 4,217,705 | 8/1980 | Donzis . | |
| 4,228,600 | 10/1980 | Krug et al. | 36/32 R |
| 4,255,877 | 3/1981 | Bowerman | 36/129 |
| 4,297,796 | 11/1981 | Stirtz et al. | 36/30 R |
| 4,297,797 | 11/1981 | Meyers | 36/44 |
| 4,302,892 | 12/1981 | Adamik | 36/31 |
| 4,316,332 | 2/1982 | Giese et al. . | |
| 4,340,626 | 7/1982 | Rudy . | |
| 4,342,158 | 8/1982 | McMahon et al. . | |
| 4,354,318 | 10/1982 | Frederick et al. | 36/30 R |
| 4,364,188 | 12/1982 | Turner et al. | 36/31 |
| 4,364,189 | 12/1982 | Bates . | |
| 4,458,430 | 7/1984 | Peterson . | |
| 4,486,964 | 7/1984 | Rudy . | |

FOREIGN PATENT DOCUMENTS

| | | | |
|---|---|---|---|
| 0096819 | 6/1983 | European Pat. Off. . | |
| 0103285 | 9/1983 | European Pat. Off. . | |
| 0108278 | 10/1983 | European Pat. Off. . | |
| 0111084 | 10/1983 | European Pat. Off. . | |
| 2107447 | 8/1972 | Fed. Rep. of Germany . | |
| 2751146 | 5/1979 | Fed. Rep. of Germany . | |
| 2904540 | 8/1980 | Fed. Rep. of Germany . | |
| 3021129 | 2/1981 | Fed. Rep. of Germany . | |
| 3029258 | 4/1982 | Fed. Rep. of Germany . | |
| 3233792 | 3/1984 | Fed. Rep. of Germany . | |
| 3245964 | 6/1984 | Fed. Rep. of Germany . | |
| 3347343 | 7/1985 | Fed. Rep. of Germany | 36/114 |
| 2522482 | 9/1983 | France | 36/28 |
| 50-30935 | 4/1975 | Japan . | |
| 55-55817 | 4/1980 | Japan | 264/244 |
| 59-168802 | 9/1984 | Japan | 36/25 R |
| 1156217 | 6/1969 | United Kingdom . | |
| 1339445 | 12/1973 | United Kingdom . | |
| 2007081 | 5/1979 | United Kingdom | 36/32 R |

*Primary Examiner*—James K. Chi
*Attorney, Agent, or Firm*—Pennie & Edmonds

[57] ABSTRACT

The manufacture of a sole unit for footwear, such as an athletic shoe including an integral midsole/wedge or a separable wedge for use with a midsole. The integral midsole/wedge unit and the separable wedge comprise a shell and a core at least partially encapsulated within the shell. In the manufacture the core is supported in a mold by a plurality of pins extending from an upper and lower mold half toward a parting line; or the core is supported on one or the other of an outsole or insole of the sole unit and closed in the mold. The material of the shell is poured or injected into the mold.

12 Claims, 11 Drawing Figures

FIG. 4.
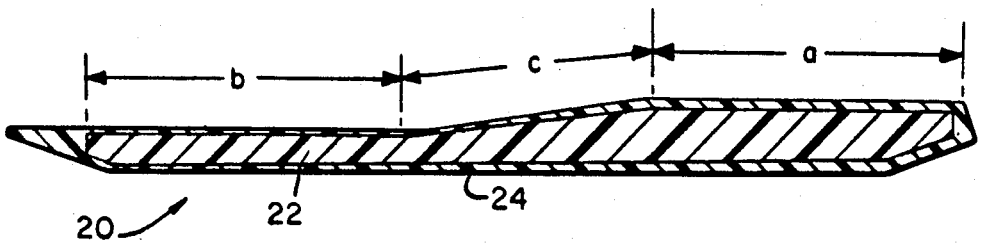
FIG. 4A.
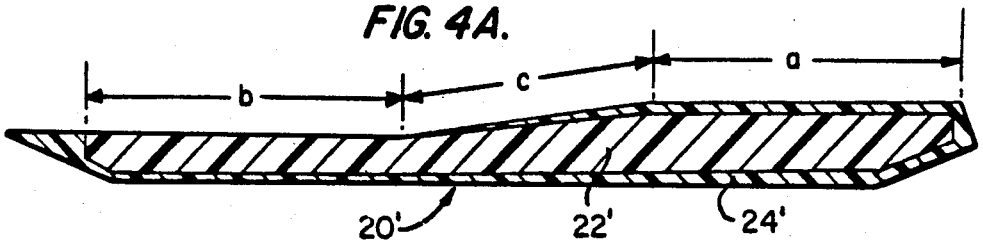
FIG. 8.
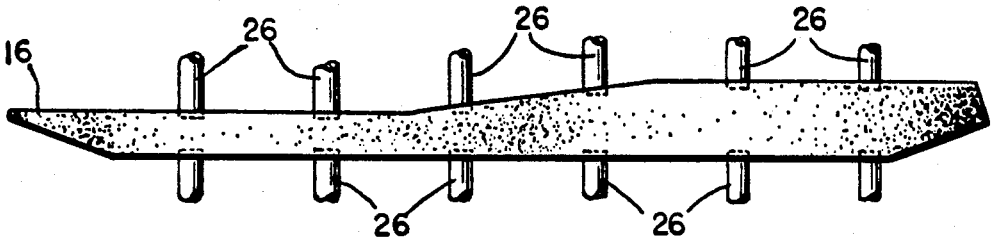
FIG. 9.
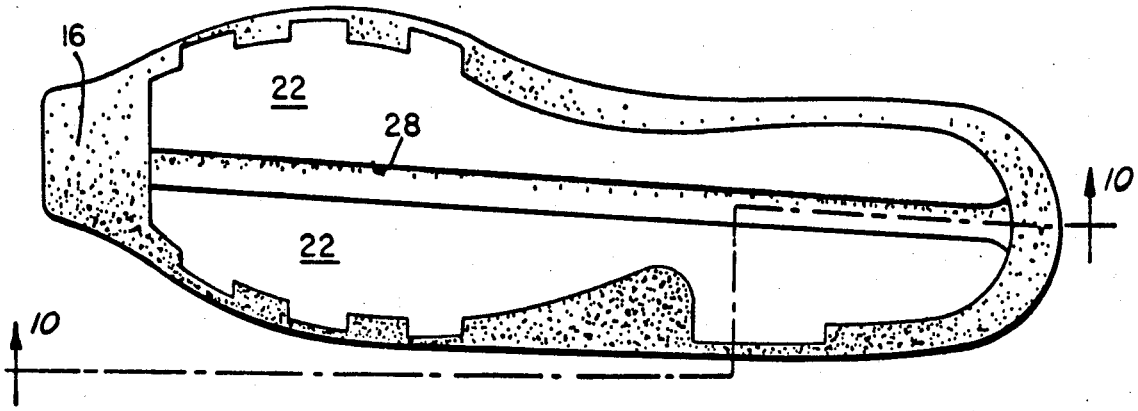
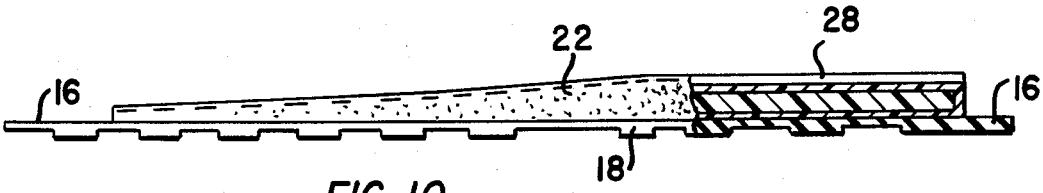
FIG. 10.

SOLE CONSTRUCTION FOR FOOTWEAR

CROSS-REFERENCE TO RELATED APPLICATION

This application is a continuation of application Ser. No. 617,388, filed June 5, 1984, now U.S. Pat. No. 4,561,140, which, in turn, is a continuation-in-part of application Ser. No. 535,288, filed on Sept. 23, 1983, now U.S. Pat. No. 4,551,930.

TECHNICAL FIELD

The invention relates to footwear, such as an athletic shoe and particularly an athletic shoe for runners, joggers and the like. In a more specific aspect, the invention relates to the techniques of fabrication of a sole unit for an athletic shoe and to the sole unit which imparts to the footwear a significant measure of functional enhancement, at least, in a capability of dispersion of shock and in an improved memory characteristic.

BACKGROUND OF THE INVENTION

Over the years there have been many attempts to construct a sole unit for an athletic shoe to meet varying requirements of feel, function and support as well as to construct the sole unit of varying materials.To this end, there have been attempts to provide a sole unit for better memory and dispersion of shock during running, as well as to meet other demands of various running groups.

One suggestion for improving a sole unit described by the prior art relates to the encapsulation by polyurethane of a medium, such as a bag filled with an inert gas, for example, nitrogen. Thus, it was the intention of the prior art to provide a sole unit which would retain certain desired characteristics imparted by the polyurethane material comprising the shell surrounding the air bag, and, at the same time, to impart from the core of the sole unit other characteristics not obtained by a midsole formed entirely of polyurethane.

While an athletic shoe of the described type may provide many desired and sought-after results, the athletic shoe of the present invention is considered to be an improvement over the known prior art.

SUMMARY OF THE INVENTION

The invention is in a type of footwear, such as an athletic shoe for runners, joggers and the like. Particularly, the invention is in a sole unit for the footwear and various techniques of manufacture of the sole unit. Typically a sole unit of footwear of this type includes an outsole, an insole and a midsole. The outsole provides a gripping surface, the insole supports the lower part of the lasted upper and the midsole may be looked upon as the principal source of various of the functional enhancements, such as those previously discussed. The invention, more particularly, is in the midsole and its fabrication.

In a first form of the invention, the midsole with an integral wedge is formed by a core and a shell, both of which are formed of a plastic material that individually and collectively enhance the overall functioning of the midsole and the athletic shoe, itself. In a preferred embodiment of the invention, the core may be formed of ethylene-vinyl acetate polymer and the shell may be formed of polyurethane. These chemically non-compatible plastic materials, each of which have distinct advantages and disadvantages in use in an athletic shoe, have been found to unexpectedly and uniquely complement one another in a construction of midsole to be more particularly described as the description continues. Thus, the core of ethylene-vinyl acetate polymer has been found to provide the function of weight relief and "bounce" or spongy feel desired by runners, as opposed to the dead feel derived from a sole unit formed entirely of polyurethane. Further, the materials in concert have been found to provide what is considered a revolutionary shock dispersion and memory system. In addition, the midsole has been found to vastly extend the protective life of the sole unit, first, by virtually eliminating the undesirable results of compression as has been experienced from the use of a prior art midsole formed solely of ethylene-vinyl acetate polymer, and, second, by introduction of unique damping or shock attenuation properties by virtue of the polyurethane material of the shell.

The sole unit may be fabricated in accordance with several techniques and through the practice of the invention each technique will locate the core of the midsole in a somewhat different location relative to both the outsole and insole. To this end, the sole unit may include a midsole including a core which is completely encased within the shell. In addition, the sole unit may include a midsole wherein the core is juxtaposed either to the outsole or to the insole. The midsole, accordingly, will include a shell that encases the core throughout either the top surface (in the direction of the upper) or the bottom surface, and along the sidewall which includes the full perimeter of the core. In a slight modification of the sole unit, first described, the core may be completely encased, except throughout the top surface in the region of the forepart of the midsole.

The shell, juxtaposed to the top and/or bottom surface of the core, may have a thickness within the range of 2 to 3 mm, plus or minus a tolerance factor, and a somewhat greater thickness along the front, back and sides which varies because of the angle of bevel or outward and downward flare of the sidewall.

In the form of midsole wherein the shell completely encases the core, the thickness of the shell along the top and bottom surface generally will taper from the heel of the sole unit towad the forepart. It is contemplated, however, that the shell may taper similarly along the top surface and have a reverse taper along the bottom surface. In this manner the resultant widths of these midsoles at the forepart will be substantially equal. In the form of midsole wherein the core is juxtaposed either to the outsole or to the insole, the thickness of the core may be within the range previously mentioned. This also is the case with the slightly modified construction of midsole. In this construction, the material of the shell will taper to a so-called feather-edge at the border of the region of the forepart of the midsole.

The plastic materials of the shell and core may be of varying durometer (Shore A). For example, the polyurethane may be about 20–40 durometer, and the ethylene vinyl acetate may be about 15–40 durometer.

In another form of the invention, the sole unit of the footwear may include a separable wedge likewise formed by a core and a shell. The manner of fabrication of the separable wedge generally may follow the techniques previously discussed using the plastic materials as previously discussed, also. Further features of the separable wedge will be considered and will become clear as the description continues.

BRIEF DESCRIPTION OF THE DRAWING

FIG. 4 is a view taken along the line 4—4 in FIG. 2 illustrating an encapsulated core;

FIG. 4A is a view like that of FIG. 4 illustrating a midsole of slightly modified form;

FIG. 8 is a schematic view of a mold assembly which mounts a plurality of pins supporting a core of a midsole, such as the midsole of FIG. 4, for encapsulation;

FIG. 9 is a plan view of a core, such as the core of FIG. 8, supported by the inner surface of an outsole of a sole unit; and FIG. 10 is a view taken along the line 10—10 in FIG. 9;

BEST MODE FOR CARRYING OUT THE INVENTION

Figure 1:
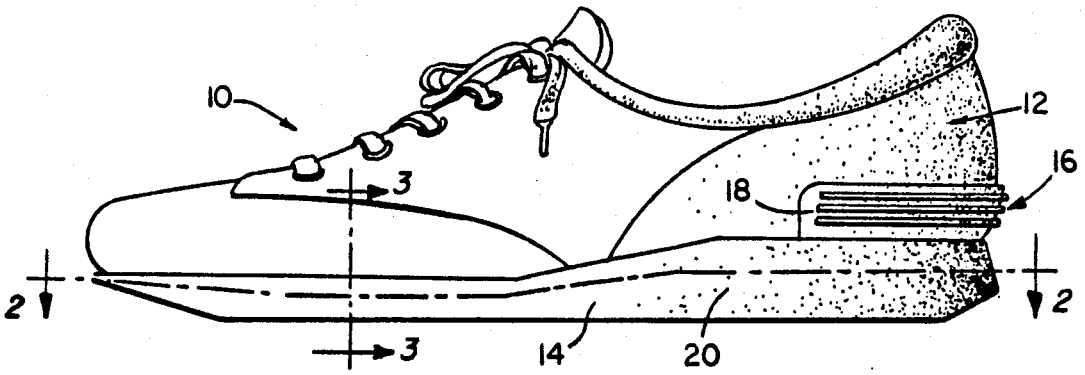
FIG. 1 is a side elevation of an athletic shoe of the invention illustrating a midsole with an integral wedge.

The footwear 10 of the invention in the form of an athletic shoe (hereafter "shoe") may be seen in FIG. 1. The shoe typically is of the type used by runners, joggers and the like and structurally may generally be characterized as including a lasted upper 12 providing a foot receiving opening, eyelets along the opening for securing laces and a sole unit 14. The sole unit typically may include an insole, an outsole (neither of which are illustrated in FIG. 1) and a midsole. The footwear 10 is shown in FIG. 1 for environmental purposes since the concepts of the invention have wider application and may be utilized with footwear of the high-top variety, as well as the low-cut variety of footwear which is illustrated.

The outsole 16 may be seen in FIGS. 9 and 10 and, as illustrated, includes a pattern of ridges 18 extending across the shoe from the medial to the lateral side for gripping a surface, or it may be formed of some other pattern design, as may be desired. The discussion will return to FIGS. 9 and 10 when further consideration is directed to the techniques of fabrication of the sole unit. The outsole is not shown in FIG. 1 so as to better illustrate the midsole 20.

According to the invention, the midsole 20 may comprise an integral midsole/wedge construction or the midsole may comprise a separable midsole and wedge. These particular constructions will be described below.

Figure 2:
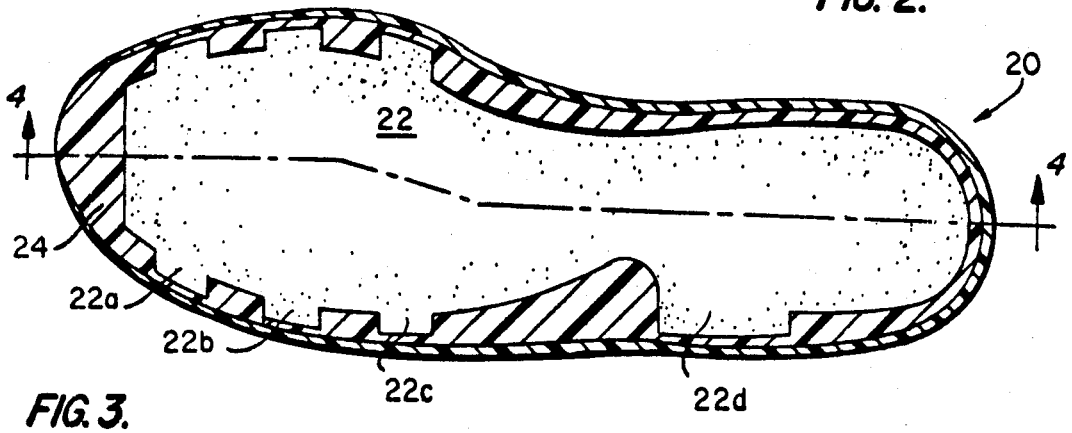
FIG. 2 is a view taken along the line 2—2 in FIG. 1, illustrating the midsole (left)
Figure 3:
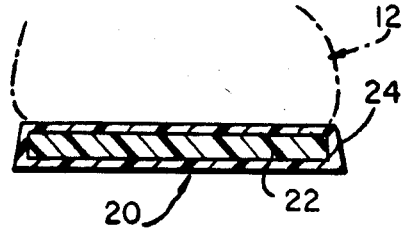
FIG. 3 is a view taken along the line 3—3 in FIG. 1.

In the first of the constructions, see FIG. 2, the midsole 20 comprises a core 22 and a jacket or shell 24. The shell, referring also to FIGS. 3 and 4, is illustrated as providing complete encapsulation of the core. In other forms of the invention the midsole may be fabricated in a fashion whereby the core is only partially encapsulated.

The core may be formed of ethylene-vinyl acetate polymer (EVA) and the shell may be formed of polyurethane (PU). While these materials are preferred, the core and shell may be formed of other materials that will also provide the functional characteristics provided in the shoe by EVA and PU. These characteristics will be brought out as the description continues. Generally, however, the material of the core will be light in weight and have a springiness in character. The material of the shell will be a material that is capable of maintaining its integrity, a supporting capability and one that will prevent the material of the core from breaking down under stress applied over a period of use of the footwear. Thus, it may be possible to use a PU of different density for both the core and the shell. According to criteria previously set out, the core will be comprised of a low density PU and the shell will be comprised of a higher density PU. A thermoplastic rubber material, utilizing the criteria of durometer range (Shore A), may be considered as a material for the core and shell of the midsole. As indicated, however, a core of EVA and a shell of PU are preferred.

The materials of the core and shell each may provide distinct advantages and disadvantages with regard to their use in the construction of a midsole for a sole unit, such as the sole unit 14. To this end, the encapsulation of the EVA core by a PU shell may be described as the complementary integration of two chemically non-compatible materials to complement one another for use in a midsole, and provide significant improvement over prior art athletic shoes in the shock dispersion and memory system. In addition, it has been found that the encapsulation of EVA/PU extends the protective life of the sole unit, first, by virtually eliminating the compression that results in the singular use in a midsole of EVA, and, second, by adding to the midsole unique damping or shock attenuation properties which derive from the shell 24 of polyurethane. Further, the core 22 within shell 24 provides the weight relief and "bounce" or spongy feel that a runner desires as opposed to the dead feel of a midsole formed totally of polyurethane.

The shell 24 of midsole 20 may vary in thickness along the top and bottom regions of core 22. Without any intent to limit the invention, but rather to more particularly describe what may be considered a preferred embodiment thereof, the shell may vary in thickness from a thickness of 2 mm±1 mm at rear or heel of the footwear, throughout both the top and bottom surfaces to a thickness of about 0.5 mm±a tolerance factor at the forepart or ball of the footwear. The wall of the shell, including the rear wall and side walls, may be considerably thicker than the shell along both the top and bottom surfaces. This increased thickness, which may be an increase of several fold, will assist in retention of the integrity of the core and overcome any possible problem of the core material delaminating. As may be seen in FIGS. 3 and 4, the shell will be thicker at the base of the midsole. This is because of outward bevel or taper around the rear wall and along the side walls which may have an angle of about 8°. As may be seen in FIG. 2, the irregular shape of the core (in plan view), as will be discussed, results in considerable variation in thickness along the medial and lateral sides of the midsole.

Referring to FIG. 4, the thickness of shell 24 at the top will be about 2 mm+1 mm along the region a, about 0.5 mm·a tolerance factor along the region b, and of a gradually decreasing thickness along the region c. The thickness of the shell at the bottom gradually decreases from the maximum thickness at the heel to the minimum thickness at the forepart or toe of the athletic shoe. The core 22 also varies in thickness over the length of the core from the heel to the forepart of the midsole. For example, the core may be about 19 mm thick at the heel and about 10 mm thick in the forepart. FIG. 4 illustrates the overall shape of the midsole including an upward taper at both the forepart and heel to accommodate the outsole 16 of the sole unit, illustrated in FIGS. 9 and 10.

Referring to FIG. 2, core 22 includes a plurality of regions 22a, 22b, . . . in the forepart of the midsole 20, oppositely directed from the main body of the core toward the side walls, and a region 22d (there could be an oppositely directed region, as well) in the rear of the midsole and likewise directed from the main body of the core toward the side walls. The regions 22a, 22b, . . . 22d add a measure of flexibility to the midsole 20, and as will be discussed in the overall molding operation may provide support surfaces for support of the core in the mold. A midsole with integral wedge, and the separable wedge for use with a midsole, both of which include an encapsulated core (or the modification previously discussed) and, also, including regions, such as regions 22a may be fabricated in a mold wherein the top and bottom surfaces of the regions provide a surface against which a plurality of pins of the mold may reside (see FIG. 8 and the discussion to follow). The midsole, also, may be fabricated by molding a shell about a core having smooth side edges, that is, without the regions. In this connection the upper and lower surfaces of the core provide the surface against which the pins may reside. The midsole may also be formed by supporting the core on either the outsole or insole, and then enclosed within a mold so that the shell forms around the core on the nonsupported sides. This will be discussed in connection with the discussion directed to FIGS. 9 and 10.

Referring to FIG. 4A, there is illustrated a modified form of midsole 20' including a core 22' and a shell 24' This variation in the midsole includes a core which is exposed throughout the top surface within the region b. The construction of this form of midsole may lend itself to more consistent manufacturing techniques. The core of FIG. 4A may vary in thickness from about 19 mm at the rear to about 8 mm at the forepart. The shell, also, may vary in thickness from the rear to the forepart of the footwear. To this end the shell has a thickness of 2 mm±1 mm at the top (within the region a). The thickness of the shell at the bottom rear is also 2 mm±1 mm. The shell will be gradually tapered along the bottom surface to a thickness of 3 mm±1 mm at the forepart of the shoe. The thickness of the side walls and rear wall may be as previously discussed.

The polyurethane which has been used successfully in the practice of the invention is designated as AT-40 (available from Kao Soap Company, Ltd., Wakayama, Japan), while the ethylene-vinyl acetate polymer is designated T1350 (available from Heiwa Rubber Ind. Co., Ltd., Kobe, Japan). A specification for these materials, molded in a mold is set out in Table I.

TABLE I

| Characteristic | AT-40 | T1350 |
|---|---|---|
| Specific gravity | 0.35 | 0.17 |
| Hardness, Shore A | 38 | 25 |
| Tensile Strength | 40 kg/cm$^2$ | 20 kg/cm$^2$ |
| Elongation (at break) | 450% | 220% |
| Tear Resistance | 14 kg/cm$^2$ | 7 kg/cm$^2$ |
| Compression Set | 12% | 58% |

Polyurethane and ethylene vinyl acetate having different hardness and density characteristics also may be used, as determined by the use criteria to be met. Thus, the EVA may have a durometer reading (Shore A) of 30, 35 and 40 in the practice of the invention. Similarly, the polyurethane may have a durometer reading (Shore A) which varies in a somewhat similar manner.

In Table II, below, specifications are set out for a molded polyurethane when molded in a mold including an EVA forepart.

TABLE II

| Characteristic | AT-40/EVA |
|---|---|
| Specific gravity | 0.55 |
| Hardness, Shore A | 45 |
| Tensile Strength | 58 kg/cm$^2$ |
| Elongation (at break) | 430% |
| Tear Resistance | 18 kg/cm$^2$ |
| Compression Set | 10% |

The midsole 20, 20' is formed by a molding process whereby a core of EVA is encapsulated by PU. In the practice of the invention, and according to the technique of FIG. 8, the core 22 (or 22'), with or without a plurality of regions along its sides, such as regions 22a, is supported in a mold (not shown) and the PU is hot/-poured into the mold. As indicated in Table II, the PU has a higher specific gravity than indicated in Table I. The higher specific gravity results since the core somewhat restricts the flow of the PU, and more poured shots may be necessary to force the PU around the core as it expands.

A plurality of pins 26 extend from both an upper and a lower mold part toward a parting line of the mold. The pins support the core both along its top and bottom surface. The point of contact of the pins with the core may be within the several regions 22a and so forth, although as previously discussed, the points of contact need not be limited to those regions and, in fact, the regions may be eliminated. While the regions, such as regions 22a, . . . may be eliminated, it should be noted that the regions increase the overall side surface area of contact between the core and shell thereby to provide for increase in the area of adhesion between the component parts of the midsole. In addition, the core may be dopped with a urethane/cement for purposes of obtaining a somewhat better degree of adhesion between what are two basically incompatible chemical materials.

FIGS. 9 and 10 may be referred to for purposes of illustration of another technique in the overall fabrication of the sole unit of a shoe, and to infer yet an additional technique in the fabrication of the sole unit of the footwear. In both techniques the core, which may be the core 22, is mounted to a component part of the sole unit 14 and the shell (not shown) either is injected or poured about the core to encapsulate the core throughout the exposed surface areas including the sides and either the top surface or bottom surface of the core. Both FIGS. 9 and 10 illustrate the core 22 supported on outsole 16. To this end, the core may be adhered to the outsole by means of a urethane cement, for example, whereby the component parts may be securely bonded by flash heating the adhesive at a temperature of about 170° C. Other adhesives as capable of use to provide this function may be resorted to. In addition, other manners and means of supporting the structures, such as by stitching, may be resorted to, also. The use of a urethane cement, however, is preferred. The core in a substantially similar manner may be supported on the insole (not shown) of the sole unit 14.

Referring to FIGS. 9 and 10, a channel 28 extends along an exposed surface of the core from the heel to the forepart. It may be necessary to include a channel in the core to assure a uniform coverage of the injected material, at desired thickness, along the exposed surface, whether the surface is an upper or lower surface. Thus, the channel will provide a path for flow of material from a material injection location and induce a flow of material into an area which otherwise may be blocked or blocked to the extent that a proper flow at an injection pressure cannot be sustained. On the other hand, the material may flow around the core quite satisfactorily without the channel 28. It is also possible that supplemental channels (not shown) connecting the lateral and medial sides of the core with the channel 28 may be required. The problem encountered in the injection of material normally do not arise when the material forming the shell is poured into the cavity, and allowed to expand around the core.

In both techniques, the material forming the shell will flow around the core and adhere to either the insole and upper or the outsole, as the case may be. The material forming the shell also will adhere to the core material and the degree of adhesion will be enhanced by use of an adhesive in the manner previously discussed. The thickness of the shell, around the sides and along either the top or bottom surface of the core are controlled by the size of the core and cavity into which the core is received. Typically the thickness will be as discussed above.

The core 22 and either the upper 12, and supporting last, or the outsole of the sole unit is supported in the cavity of a mold. The mold is closed and sealed so that the material from which the shell is formed may be either poured or injected into the cavity. These particular porcesses of pouring or injecting material into a mold are well-known, as is the type of equipment which may be utilized. For example, equipment of the type which may be used is manufactured by Bata Engineering, as well as Desma, such as the Desma rotary installations disclosed in their bulletin, identified DGM 1500 8.78 and technical data relating to the Desma 1511-1514 machines.

Figure 5:
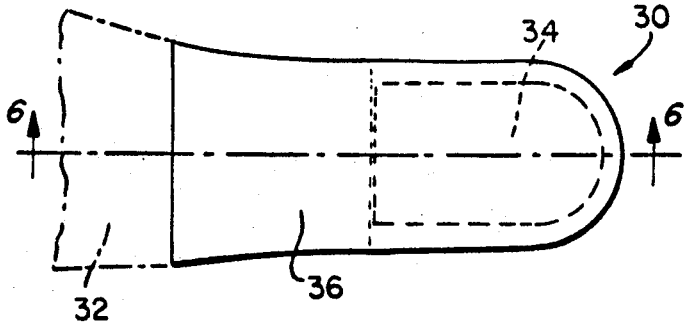
FIG. 5 is a plan view of a separable wedge for use with a midsole.
Figure 6:
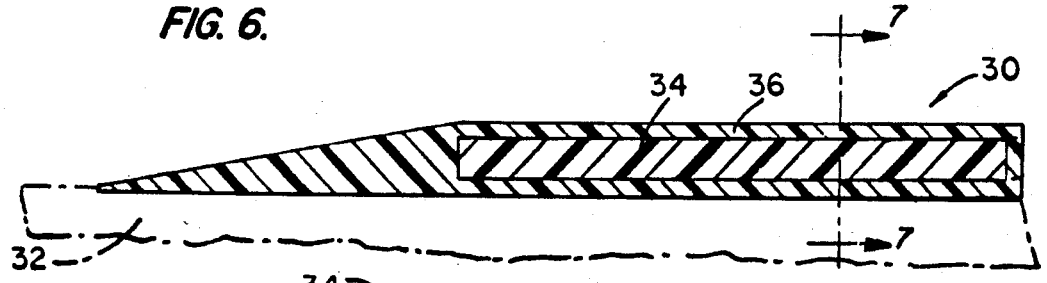
FIG. 6 is a view taken along the line 6—6 in FIG. 5, in somewhat larger scale, illustrating an encapsulated core.
Figure 7:
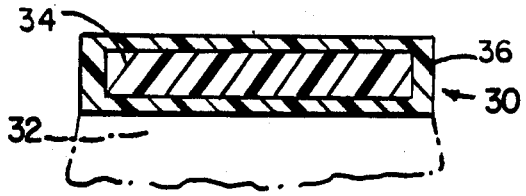
FIG. 7 is a view taken along the line 7—7 in FIG. 6.

Referring now to FIGS. 5, 6 and 7, there is illustrated a separable wedge 30 for use in an athletic shoe including a midsole of conventional construction. The wedge 30 is formed to a final construction, which may be likened to that of midsole 20, by a process technique which generally follows one of the process techniques previously described. To this end, the wedge includes a core 34 and a shell 36, and is of an overall size to accommodate various sizes and widths of the athletic shoes with which it is used. A schematic presentation of the midsole 32 may be seen in the Figures.

More particularly, the core 34 is formed of EVA, such as T1350, and the shell 36 is formed of PU such as AT-40. These specific designations are exemplary, and as previously discussed, EVA having durometers of 30, 35 and 40 (Shore A) are contemplated. Varying durometer of PU is also contemplated. One specific example of wedge construction may be, as follows:

length—about 155 mm
thickness
  heel—about 12.7±1 mm
  instep—about 1 mm
taper (length from heel to instep)—about 60 mm
core (thickness)—9 mm±1
shell
  (top and bottom)—1.5 mm
  (sides and rear)—1.5 mm The core 34 may be formed to a rectangular body of a length which extends to the break point of the wedge, that is, the point that at which the wedge tapers toward the instep. Other options of contour, such as the core extending further along the wedge to mirror the wedge bevel may be considered. In the manner of the midsole 20, the wedge 30 provides both increased shock dispersion in the heel of the shoe and substantially eliminates the compression of the core of EVA.

The process of fabrication of the wedge may follow generally the process of fabrication of the midsole 20. To this end, the core 34 will be supported as a full unit in a mold, allowing, as set out in the specifications, above, for a flow path of about 1.5 mm around the rear and side wall, as well as over the top and bottom walls of the core. The core may be supported by a plurality of pins, also as previously discussed.

We claim:

1. A midsole for use in the sole unit of footwear, such as an athletic shoe comprising a core composed of plastic material which is light of weight, providing a characteristic of springiness, and a shell also composed of plastic material more dense than the plastic material of said core, said shell being molded and partially disposed about said core covering one of its opposed surfaces throughout and extending to but substantially not beyond the plane including the other opposed surface thereby to cover the entire peripheral side of said core between surfaces, leaving substantially uncovered the other of the opposed surfaces, and said shell serving at least to maintain integrity and prevent break down and/or compression of said core under stress.

2. The midsole of claim 1 wherein said uncovered surface of said core faces the upper of said athletic shoe.

3. The midsole of claim 1 wherein said uncovered surface of said core faces away from the upper of said athletic shoe.

4. The midsole of any one of claims 2 or 3 further comprised of an integral heel wedge portion.

5. The midsole of claim 2 further comprised of an integral heel wedge portion, and wherein said core is located within said heel wedge portion.

6. The midsole of claim 1 wherein said core is composed of a first plastic material having a durometer reading (Shore A) of at least 15, and said shell is composed of a second, different plastic material having a durometer reading (Shore A) of at least 20.

7. The midsole of any one of claims 1, 5 and 6 wherein said core is composed of ethylene-vinyl acetate polymer, and said shell is composed polyurethane.

8. A wedge for use in the sole unit of footwear, such as an athletic shoe comprising a core composed of plastic material which is light of weight, providing a characteristic of springiness, and a shell also composed of plastic material more dense than the plastic material of said core, said shell being molded and partially disposed about said core covering one of its opposed surfaces throughout and extending to but substantially not beyond the plane including the other opposed surface thereby to cover the entire peripheral side of said core between surfaces, leaving substantially uncovered the other of the opposed surfaces, and said shell serving at least to maintain integrity and prevent break down and/or compression of said core under stress.

9. The wedge of claim 8 in combination with a midsole, and wherein the uncovered surface of said core is positioned juxtaposed said midsole.

10. The wedge of claim 8 wherein said core is composed of a first plastic material having a durometer reading (Shore A) of at least 15, and said shell is composed of a second, different plastic material having a durometer reading (Shore A) of at least 20.

11. The wedge of claim 10 wherein said core is composed of ethylene-vinyl acetate polymer, and said shelll is composed of polyurethane.

12. Footwear in the form of an athletic shoe including a sole unit having an outsole and one of a midsole and wedge recited in one of claims 5 and 8, and an upper received on said sole unit having a foot receiving opening.

* * * * *